US007896443B2

(12) United States Patent
Brisebois

(10) Patent No.: US 7,896,443 B2
(45) Date of Patent: Mar. 1, 2011

(54) ORE EXTRACTION USING COMBINED BLAST AND THERMAL FRAGMENTATION

(75) Inventor: Donald Brisebois, Ile-Perrot (CA)

(73) Assignee: Rocmec International Inc., Chicoutimi, Quebec (CA)

( * ) Notice: Subject to any disclaimer, the term of this patent is extended or adjusted under 35 U.S.C. 154(b) by 0 days.

(21) Appl. No.: 12/697,521

(22) Filed: Feb. 1, 2010

(65) Prior Publication Data

US 2010/0156167 A1 Jun. 24, 2010

Related U.S. Application Data

(63) Continuation of application No. PCT/CA2008/001372, filed on Jul. 24, 2008.

(60) Provisional application No. 60/953,555, filed on Aug. 2, 2007.

(51) Int. Cl.
*E21C 35/00* (2006.01)

(52) U.S. Cl. ..... 299/14; 299/13

(58) Field of Classification Search ..... 299/14, 299/13, 10; 102/313, 301, 314
See application file for complete search history.

(56) References Cited

U.S. PATENT DOCUMENTS 3,465,818 A * 9/1969 Dixon ..... 299/13
2005/0012381 A1* 1/2005 Brisebois ..... 299/14

FOREIGN PATENT DOCUMENTS

KR 2002002348 A * 1/2002

* cited by examiner

*Primary Examiner*—John Kreck
(74) *Attorney, Agent, or Firm*—Ogilvy Renault LLP

(57) ABSTRACT

A process for extracting ore from a vein (10) comprises drilling spaced-apart boreholes (16) directly in the vein (10). The boreholes (16) are enlarged using thermal fragmentation generally up to the boundaries between the vein and surrounding waste. A blasthole (18) is then drilled in the vein between the thermally enlarged boreholes (17) for placement of explosive. The explosive is fired to break the ore between the enlarged boreholes (17). The enlarged boreholes (17) act as weakening regions to direct the blasting effect and minimize dilution.

9 Claims, 2 Drawing Sheets

ORE EXTRACTION USING COMBINED BLAST AND THERMAL FRAGMENTATION

RELATED APPLICATIONS

This is a continuation of International PCT Application No. PCT/CA2008/001372 filed on Jul. 24, 2008, which claims the benefit of U.S. patent application No. 60/953,555 filed Aug. 2, 2007.

TECHNICAL FIELD

The present application generally relates to a process for extracting mineral deposit using thermal fragmentation to provide directional blast.

SUMMARY

It is an aim to minimize extraction costs by reducing ore dilution.

Therefore, in accordance with a general aspect, there is provided a process for extracting ore from a vein, comprising: a) drilling spaced-apart boreholes directly in the vein, b) using thermal fragmentation, enlarging the boreholes generally up to the boundaries between the vein and surrounding waste to provide adjacent thermally enlarged boreholes, c) drilling at least one blasthole in the vein between two adjacent enlarged boreholes for placement of explosive, and d) detonating the explosive to break the ore between said two enlarged boreholes.

In accordance with a further general aspect, there is provided a process for extracting ore from a vein having sidewalls extending along an axis, comprising providing two axially spaced-apart weakening regions along said vein, said weakening regions offering less resistance to pressure than said sidewalls, at least one of said weakening regions being obtained using thermal fragmentation, drilling a blasthole in said vein between said weakening regions, placing an explosive charge in the blasthole, firing the explosive charge to provide a blast, the blast being directed towards the weakening regions where there is less resistance.

DESCRIPTION OF THE PREFERRED EMBODIMENTS

Figure 1:
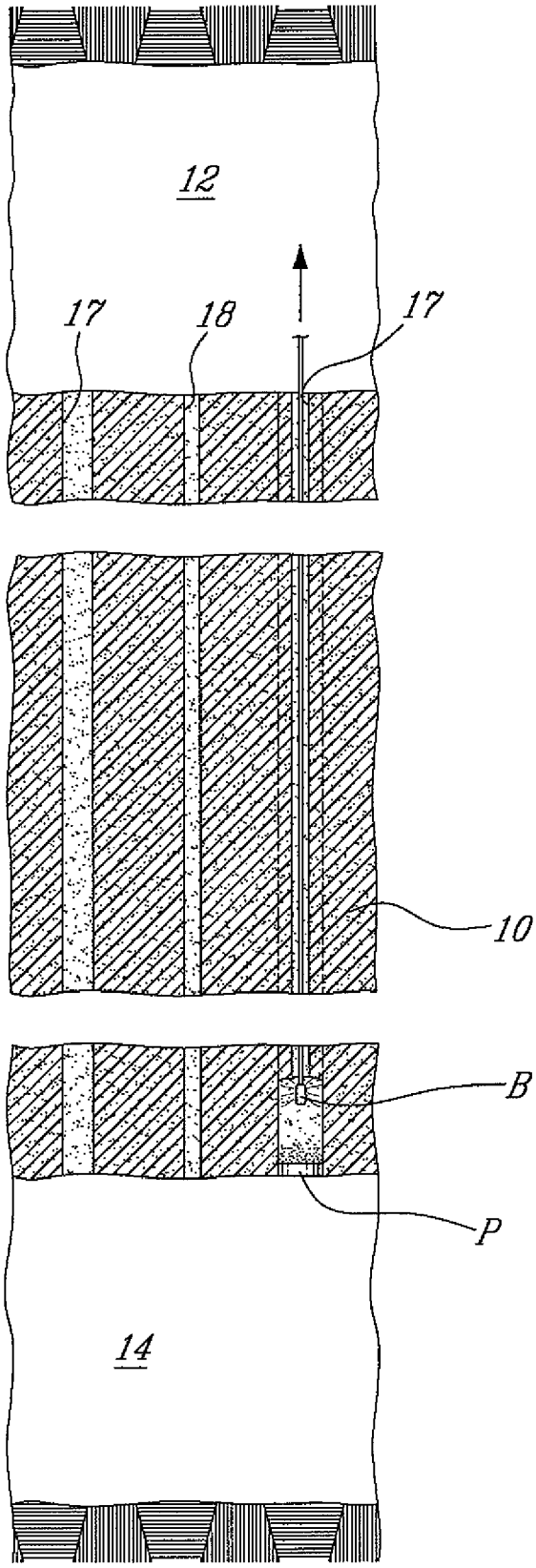
FIG. 1 is a side elevation view of an underground ore vein extending between two excavated drifts extending along the course of the vein and providing access to the vein.

FIG. 1 illustrates an underground ore body 10 or vein extending between two horizontal drifts 12 and 14 accessible from the ground surface through a ramp or a vertical opening known as a shaft (not shown). As known in the art, the shaft is equipped with elevators by which the workers, machines and material can gain access to the galleries or drifts 12 and 14. The drifts 12 and 14 are tunnels made in the rock with a size and shape to permit mining of the ore body 10. Each drift defines a working level running through the ore body. The working levels can for instance be vertically spaced by about 18 m (59 feet).

Figure 2:
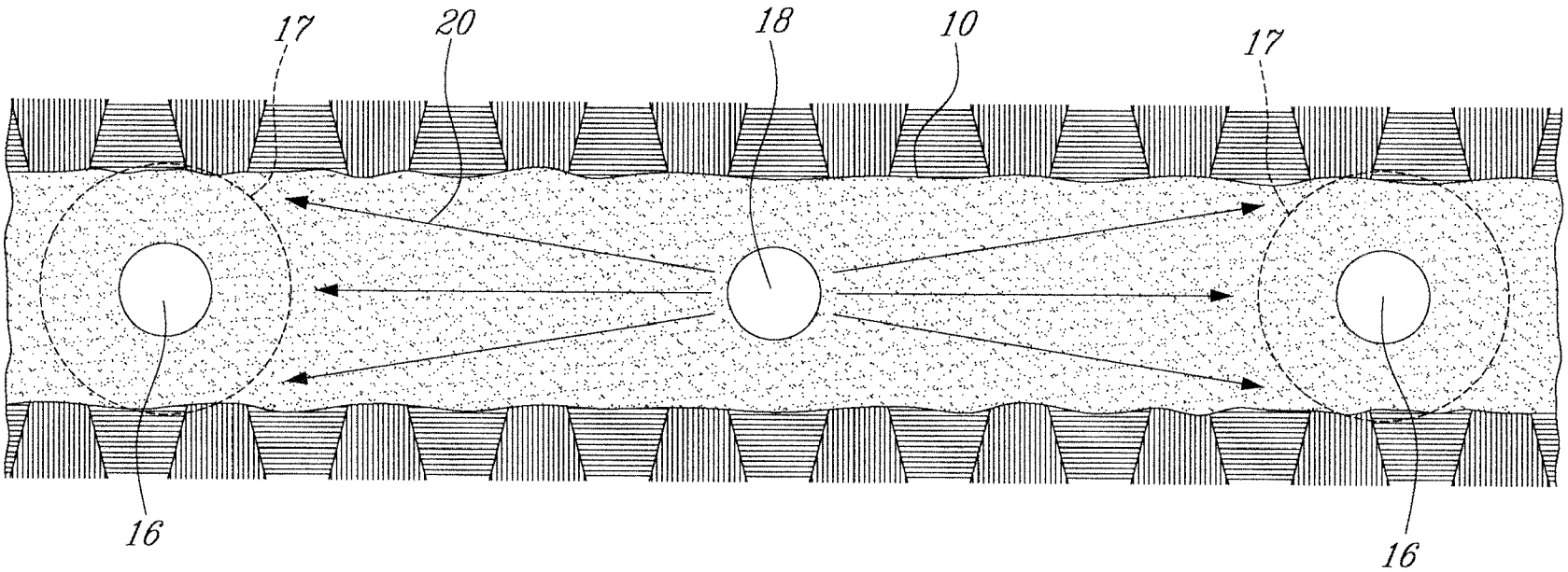
FIG. 2 is a top plan view of the ore vein shown in FIG. 1.

As shown in FIGS. 1 and 2, boreholes 16 (only two being shown in FIGS. 1 and 2) are drilled at regular intervals along the vein 10, each borehole extending vertically though the vein 10 from the top drift 12 to the bottom drift 14. The diameter of these holes is typically in the range of 6 inches (15.2 cm). The diameter of the holes 16 is not critical but is preferably kept as small as possible to minimize drilling costs and time. The diameter must however be sufficient to permit hole enlargement by thermal fragmentation. Each borehole 16 can be drilled haft way through from the top drift 12 and the bottom drift 14 in order to limit hole deviation. It is however understood that the holes 16 can be completely drilled from the top drift 12 to the bottom drift 14. As will be seen hereinafter, the spacing between adjacent boreholes 16 is selected such as to provide sufficiently closed expansion rooms or blast containing rooms such that the mass of ore between adjacent holes can be broken by a blast with minimum ore dilution in the surrounding waste. The boreholes 16 are used to contain as much as possible the blast within the boundaries of the vein 10, thereby minimizing dilution. Satisfactory results have been obtained with a 6 m (19.68 ft) center to center distance between two consecutive boreholes.

The drilled boreholes 16 are individually thermally enlarged as per the way described in U.S. Pat. No. 6,913,320 issued on Jul. 5, 2005, the content of which is herein incorporated by reference. More specifically, each borehole 16 is enlarged by lowering a burner B (FIG. 1) into the borehole, by igniting it and then gradually raising it until the borehole is completely enlarged from a bottom end to a top end thereof. A plug P is installed in the bottom of the boreholes 16 to seal the same and provide for a build-up of temperature in the borehole. The heat generated by the burner B raises the temperature in the hole up to 1800° C. This creates thermal stresses that spall the ore. In simple terms, spalling is considered to be a form of decrepitation caused by an unequal expansion of mineral crystals which overcomes molecule cohesion. The broken or fragmented material produced during this process ranges in size from fine grain to 4 cm (1.6 inch). The plug is removed and the broken material is recuperated by any suitable methods. The boreholes 16 are typically enlarged up to the sidewall of the vein (i.e. the boundaries between the ore body and the surrounding waste) to provide thermally enlarged boreholes 17 as schematically shown in dotted lines FIG. 2. For illustrative purposes, the spacing between the boreholes 16 can be selected to leave about 1 m (3.28 feet) of ore between two adjacent enlarged boreholes 17 for a vein having a width ranging from about 13 inches (33 cm) to about 15 inches (38.1 cm). The spacing between adjacent holes is not only function of the width of the vein but also of the explosive that will be used to break the ore between the so enlarged weakening holes. As mentioned herein above satisfactory results have been obtained with a distance of 6 m (19.69 feet) between the centers of adjacent boreholes 16.

Once the first two drilled holes have been thermally enlarged and emptied as described hereinabove, at least one blasthole 18 is drilled through the vein 10 between two adjacent enlarged holes 17, as shown in FIGS. 1 and 2. If only one blasthole 18 is drilled it is generally located midway between the enlarged holes 17. Each blasthole 18 is generally spaced by 80 cm (31.5 inches) from the periphery of the adjacent enlarged hole 17. The blasthole 18 can be drilled haft way through from the upper drift 12, the other haft being drilled from the lower drift 14. Alternatively, the blasthole can be fully drilled from the upper drift 12. The diameter of the blasthole 18 is typically in the range of 2½ inches (6.4 cm). It is understood that the blasthole diameter can vary depending on the type of explosive to be loaded therein.

The selected explosive charge is loaded into the blasthole 18 and is then fired to break the ore present between the two enlarged holes 17. As shown by arrows 20 in FIG. 2, the blast is substantially contained within the boundaries of the vein 10 between the enlarged holes 17. When an explosive charge explodes a powerful force is exerted in generally all directions but most movement occurs along the line of least resistance or least confinement. The enlarged boreholes 17 provide weakening regions of less resistance than that of the sidewall of the vein. The propagation or explosive force will thus be directed toward the enlarged holes 17 in the vein 10 and not into the surrounding waste which offers greater resistance, thereby minimizing dilution. By so providing boreholes in the vein on opposed sides of the blasthole 18, the blasting effect can be contained generally longitudinally along the vein. In other words, the enlarged boreholes 17 define the blasting propagation line.

Once a given section of the vein has been broken by a directional blast as described above, another borehole is drilled in the vein 10 at a selected distance from the initial blasted site. The drilled borehole is then enlarged by thermal fragmentation as described hereinabove and a second blasthole is drilled in the vein at an intermediate location between the exploded site and the newly enlarged bore hole. The blasthole is then filled with an explosive charge, which is then fired to break the ore between the first exploded site and the newly enlarged borehole. Again, the blast propagation take place where there is least resistance, in other words along the line between the first exploded site and the newly enlarged borehole. This process is repeated as required to recover the desired quantity of ore from the ore vein. It is also understood that all the boreholes and the blastholes can be drilled in a first time followed by the thermal fragmentation of the boreholes. The vein can then be blasted in sequence. Other drilling and blasting sequence are contemplated as well.

What is claimed is:

1. A process for extracting ore from a vein, comprising: a) drilling spaced-apart boreholes directly in the vein, and providing a plug in a bottom end of each of the spaced-apart boreholes, b) using thermal fragmentation, enlarging the boreholes generally up to the boundaries between the vein and surrounding waste to provide adjacent thermally enlarged boreholes, c) drilling at least one blasthole in the vein between two adjacent enlarged boreholes for placement of explosive, and d) detonating the explosive to break the ore between said two enlarged boreholes.

2. The process defined in claim 1, wherein the distance between the centers of two adjacent boreholes is about 6 meters and less.

3. The process defined in claim 2, wherein the at least one blast hole is drilled at about 80 centimeters or more from a periphery of an adjacent enlarged borehole.

4. The process defined in claim 1, comprising removing the plug once the thermal fragmentation has been completed and recuperating the fragmented ore before proceeding with step d).

5. The process defined in claim 1, wherein step b) comprises lowering the burner into said boreholes down to the bottom end thereof and gradually raising the burner towards a top end thereof to gradually enlarge the boreholes from the bottom to the top ends thereof.

6. A process for extracting ore from a vein having sidewalls extending along an axis, comprising providing two axially spaced-apart weakening regions along said vein, said weakening regions offering less resistance to pressure than said sidewalls, at least one of said weakening regions being obtained using thermal fragmentation, drilling a blasthole in said vein between said weakening regions, placing an explosive charge in the blasthole, firing the explosive charge to provide a blast, the blast being directed towards the weakening regions where there is less resistance, wherein the step of providing two axially spaced-apart weakening regions comprises: drilling two spaced-apart boreholes in the vein between said sidewalls, and using thermal fragmentation to enlarge said two spaced-apart boreholes up to said sidewalls, and wherein the thermal fragmentation comprises plugging the spaced-apart boreholes and igniting a burner therein.

7. The process defined in claim 6, wherein the boreholes are enlarged from a bottom end to a top end.

8. The process defined in claim 6, comprising removing the plug from the boreholes once the same have been enlarged by thermal fragmentation, and recuperating the fragmented ore before firing the explosive charge.

9. The process defined in claim 6, wherein the center of the spaced-apart boreholes are spaced by about 6 meters or less so as to leave a land between the tow spaced-apart boreholes, and wherein once enlarged to the sidewalls of the vein, said land has a length of about 1 meter.

* * * * *